US005388426A

United States Patent [19]

Wada et al.

[11] Patent Number: 5,388,426

[45] Date of Patent: Feb. 14, 1995

[54] AIR CONDITIONER

[75] Inventors: Kouji Wada; Takashi Sato; Masayoshi Shimura, all of Fuji, Japan

[73] Assignee: Kabushiki Kaisha Toshiba, Kawasaki, Japan

[21] Appl. No.: 90,399

[22] Filed: Jul. 13, 1993

[30] Foreign Application Priority Data

Aug. 26, 1992 [JP] Japan ..... 4-227191
Aug. 28, 1992 [JP] Japan ..... 4-230264

[51] Int. Cl.[6] ..... F25D 23/12
[52] U.S. Cl. ..... 62/263; 165/122
[58] Field of Search ..... 62/262, 263, 265; 454/233; 165/122

[56] References Cited

U.S. PATENT DOCUMENTS 2,250,352 7/1941 Bolcom ..... 62/262 X
3,395,752 8/1968 Fowell ..... 165/122 X
5,211,219 5/1993 Kawabata et al. ..... 165/122

FOREIGN PATENT DOCUMENTS 58-67675 5/1983 Japan .
0438784 11/1935 United Kingdom .
0446378 4/1936 United Kingdom .
0923277 4/1963 United Kingdom .
1023911 3/1966 United Kingdom .
2199935 7/1988 United Kingdom .

*Primary Examiner*—William E. Tapolcai
*Attorney, Agent, or Firm*—Cushman Darby & Cushman

[57] ABSTRACT

An air conditioner includes a case assembly having a front portion, a rear portion, and a top portion in which a suction aperture is formed, a heat exchanger, located in the case assembly, for performing heat exchange with respect to an indoor air introduced through the suction aperture. A blower is located in the case assembly, for supplying the indoor air introduced through the suction aperture into the heat exchanger and for expelling the indoor air from the case assembly after the heat exchange by the heat exchanger. And, open-close means are provided for the top portion of the case assembly, for selectively opening or closing the suction aperture.

12 Claims, 4 Drawing Sheets

AIR CONDITIONER

BACKGROUND OF THE INVENTION

1. Field of the Invention

The present invention relates to an air conditioner of a separate type having indoor and outdoor units, and more particularly, to an improvement of the indoor unit of the air conditioner.

2. Description of the Related Art

Many indoor units of separate-type air conditioners are mounted near ceiling portions of indoor wall surfaces. In general, these indoor units comprise a case assembly formed of front and rear cases, an indoor heat exchanger therein, and a cross-flow fan located behind the exchanger in the case assembly.

In the indoor unit, the cross-flow fan is rotated to suck in air from a room through a suction aperture in the front face of the front case. The suction air passes through the indoor heat exchanger, thereby exchanging heat with a working fluid which circulates in the exchanger. After being regulated in temperature by the heat exchange, the air is blown off into the room through a blow-off aperture in the lower portion of the front case.

Due to the recent housing situation, there is an urgent demand for compact indoor units with reduced height. To meet this demand, some indoor units are designed so that the indoor heat exchanger is inclined backward at a predetermined angle with respect to the vertical line. In these indoor units, the front side of the heat exchanger faces diagonally upward. In some cases, therefore, the suction aperture is located at the top portion of the front case which faces the ceiling of the room.

However, dust easily collects in the suction aperture situated in this position, and often enters the case assembly and adheres to the heat exchanger. If the unit is left in this state for a long period of time, especially during the off-season, the cooling or heating performance of the air conditioner will have been lowered before the restart of use.

SUMMARY OF THE INVENTION

The object of the present invention is to provide an air conditioner enjoying a high heat exchange performance, in which dust can be effectively prevented from collecting in a suction aperture or entering a case assembly when the aperture is formed in the upper portion of the case assembly.

According to the present invention, there is provided an air conditioner which comprises a case assembly having a suction aperture at the top portion thereof, an indoor heat exchanger in the case assembly, a blower in the case assembly for introducing suction air through the suction aperture into the indoor heat exchanger, and open-close means for opening and closing the suction aperture.

DETAILED DESCRIPTION OF THE PREFERRED EMBODIMENTS

An air conditioner according to an embodiment of the present invention will now be described with reference to the accompanying drawings of FIGS. 1 to 8.

Figure 1:
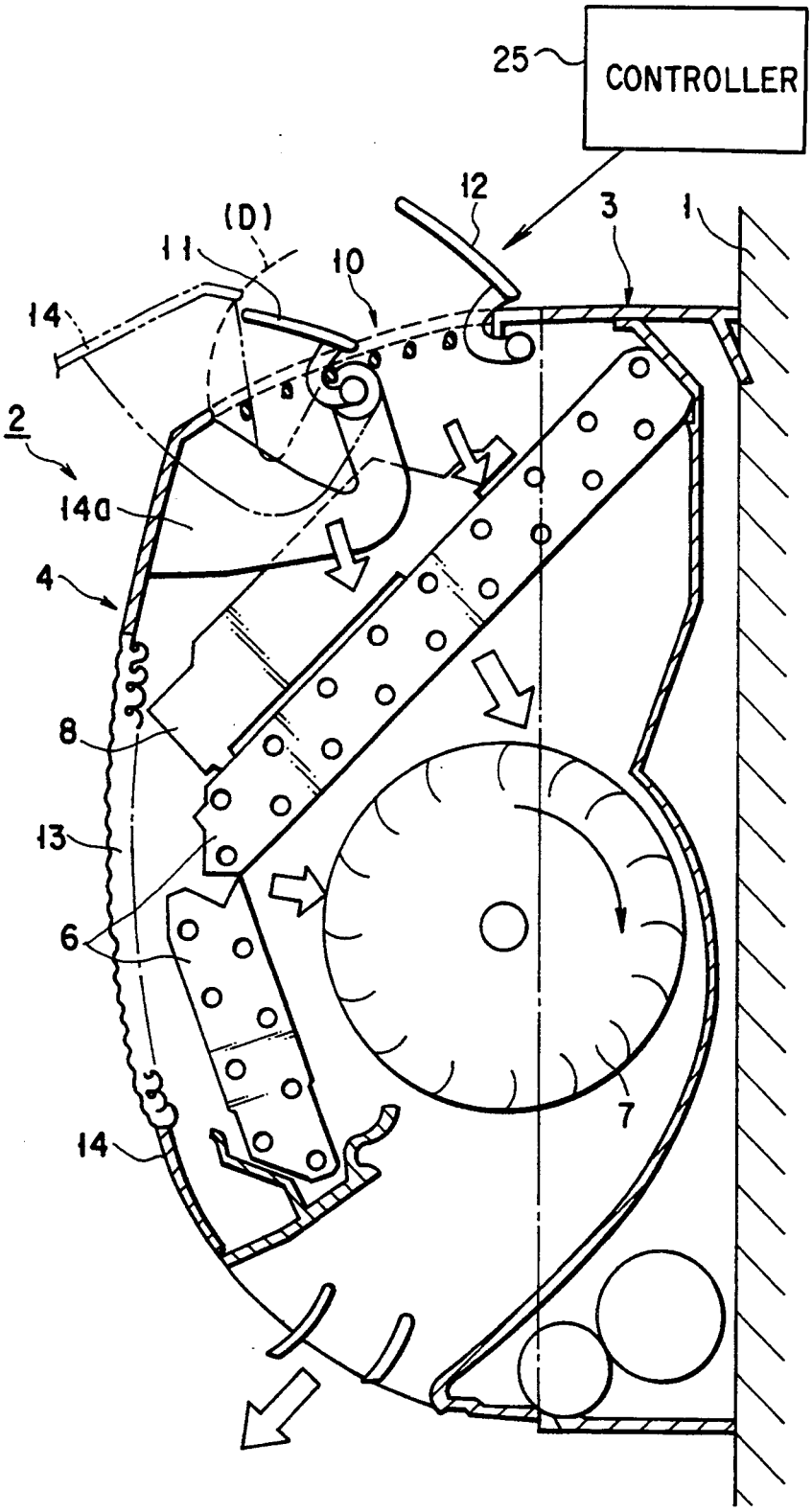
FIG. 1 is a vertical sectional view schematically showing an indoor unit of an air conditioner according to an embodiment of the present invention.

In FIG. 1, numeral 1 denotes an indoor-side wall surface. The wall surface 1 is fitted with an indoor unit 2 which is connected to an outdoor unit (not shown). The indoor unit 2 comprises a case assembly, which is composed of a rear case 3 and a front case 4, as well as a heat exchanger 6 and a cross-flow fan 7 in the case assembly. The exchanger 6 and the fan 7 are fixed to the rear case 3.

The heat exchanger 6 has a substantially L-shaped structure, bent in the middle with respect to the height direction, and a dust collector 8 is mounted on the upper front portion of the exchanger 6. A first suction aperture 10 is formed in the top portion of the front case 4 so as to face the upper front portion of the heat exchanger 6. The suction aperture 10 is fitted with first and second louvers 11 and 12 for use as open-close means for opening and closing the aperture 10. These louvers are spaced in the depth direction.

Figure 2:
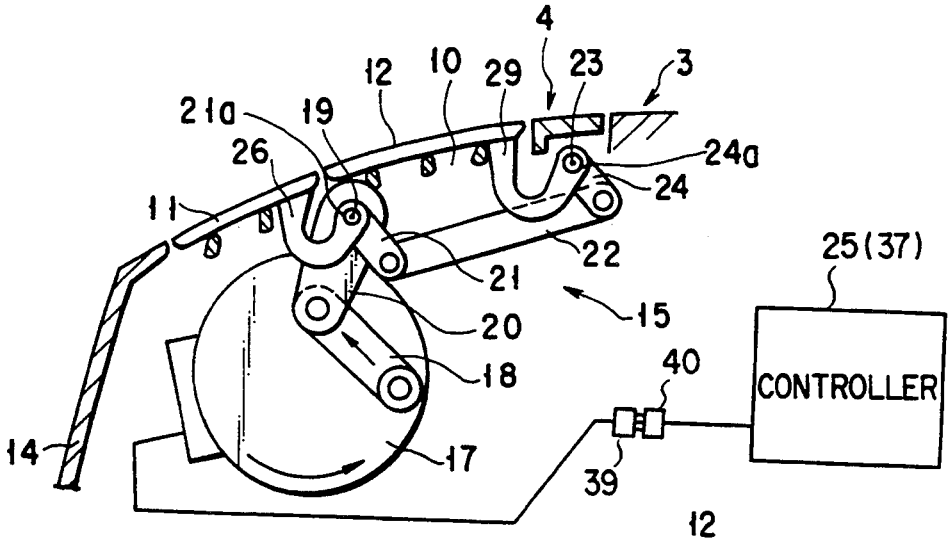
FIG. 2 is an enlarged vertical sectional view showing a suction aperture at the upper portion of a case assembly.
Figure 3:
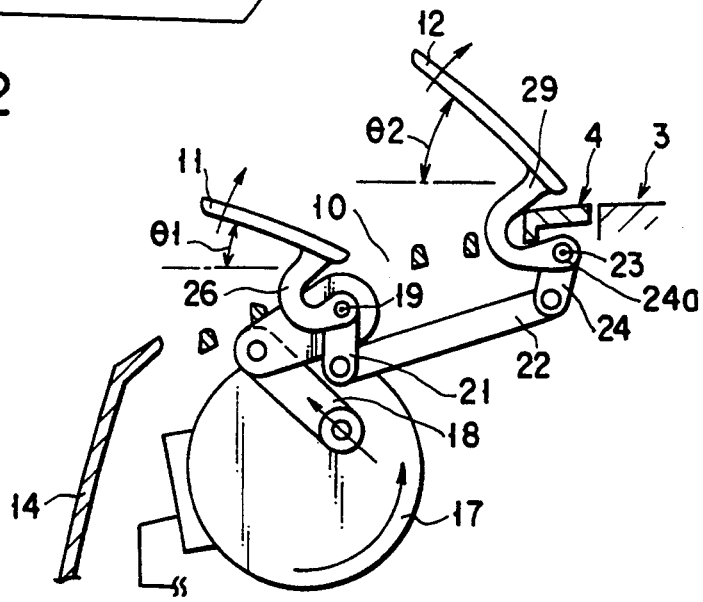
FIG. 3 is a vertical sectional view for illustrating an operation for opening or closing the suction aperture.

As shown in the enlarged views of FIGS. 2 and 3, the first and second louvers 11 and 12 are driven by means of a louver drive mechanism 15, which is located at the upper portion of the front case 4.

As shown in FIG. 2, the drive mechanism 15 comprises a servomotor 17 fixed to the upper portion of the front case 4, a first connecting rod 18 which is driven in the direction of the arrow as the servomotor 17 operates, and a first driven lever 20 connected to the other end portion of the first rod 18 and pivotable around an axis 19. The mechanism 15 further comprises a second driven lever 21 connected to the first lever 20 and pivotable around the same axis 19, a second connecting rod 22 connected to the distal end portion of the second lever 21, and a third driven lever 24 connected to the other end of the second rod 22 and pivotable around an axis 23.

The servomotor 17 is connected to the controller indicated by 25 in FIG. 2, and the drive mechanism 15 operates on the basis of control signals supplied from by the controller 25.

Figure 5:
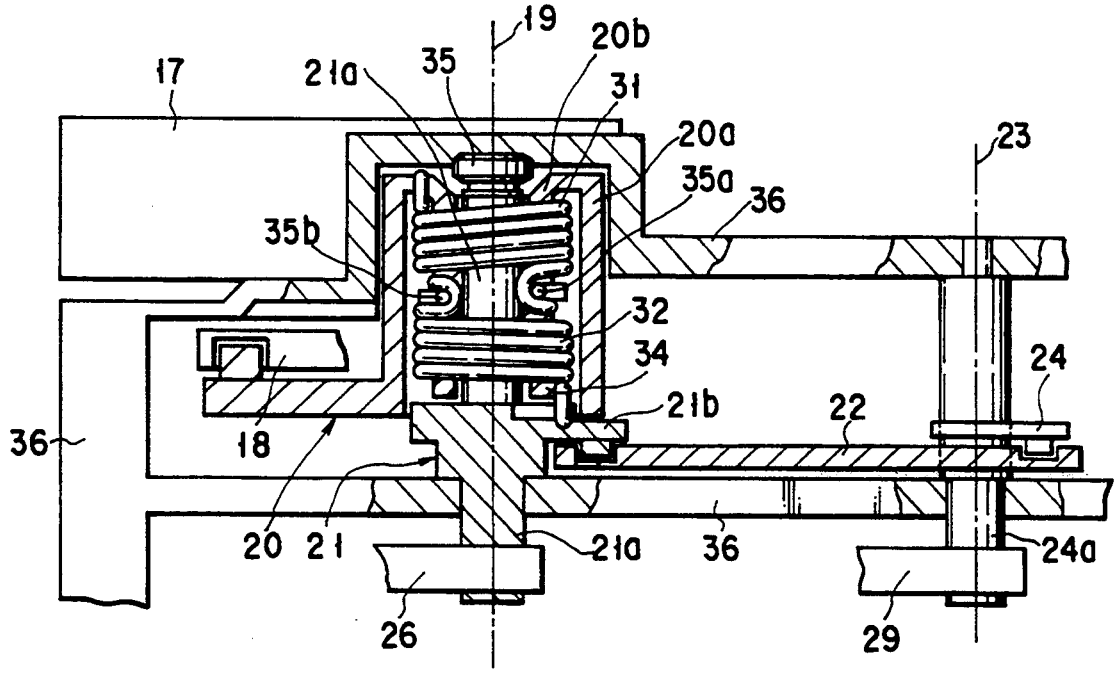
FIG. 5 is a cross-sectional view showing a louver drive mechanism.

As shown in FIG. 5, an arm 26 for holding the first louver 11 is fixed to a pivot 21*a* of the second driven lever 21. As the driven lever 21 pivots, the first louver 11 pivots around the axis 19, thereby opening or closing the first suction aperture 10, as shown in FIG. 3.

As shown in FIG. 5, moreover, an arm 29 for holding the second louver 12 is fixed to a pivot 24*a* of the third driven lever 24. As the driven lever 24 pivots, the second louver 12 pivots around the axis 23, thereby opening or closing the first suction aperture 10, as shown in FIG. 3.

The third driven lever 24 is a little longer than the second driven lever 21, so that an elevation angle $\theta_2$ of the second louver 12 is always wider than an elevation angle $\theta_1$ of the first louver 11.

Figure 4:
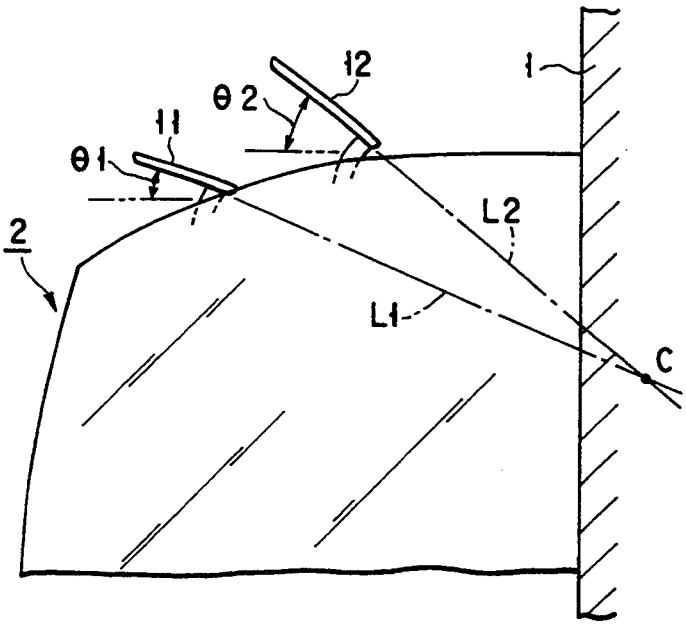
FIG. 4 is a partial side view showing the relationship of the respective angles of elevation of first and second louvers.

The relation between the respective elevation angles $\theta_1$ and $\theta_2$ of the first and second louvers 11 and 12 is such that rear extensions $L_1$ and $L_2$ of the louvers 11 and 12 intersect each other at a point (C) outside the rear case 3 which constitutes the indoor unit 2, as shown in FIG. 4. Thus, suction air currents can be effectively prevented from running against one another in the indoor unit 2, so that the first louver 11 can be effectively prevented from lowering the rectifying capability of the second louver 12.

Figure 6:
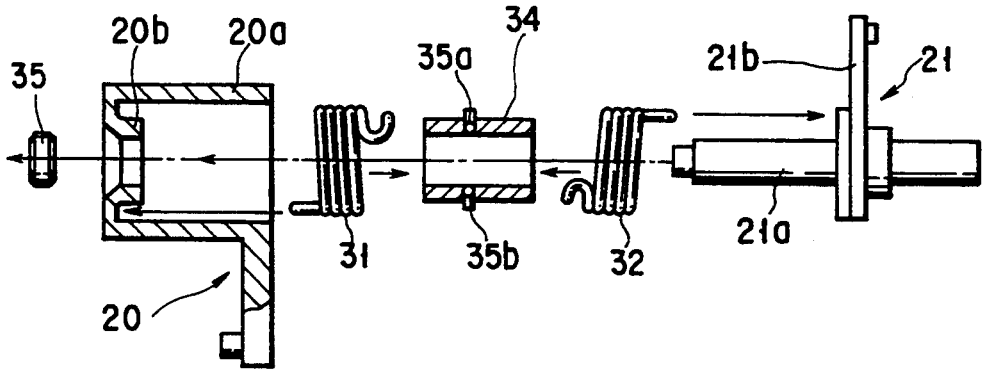
FIG. 6 is an exploded cross-sectional view showing part of the louver drive mechanism.

The first and second driven levers 20 and 21 shown in FIG. 2 are elastically connected to each other in the pivoting direction. This is done in order to prevent the servomotor 17 or the louver drive mechanism 15 from being broken by an extraordinary load which may be applied thereto if the first or second louver 11 or 12 is disabled or restrained from opening or closing the aperture by a ceiling or the like which engages the louver. Referring now to FIGS. 5 and 6, a method for this connection will be described.

FIG. 5 is a plan view of the louver drive mechanism 15. In FIG. 5, numerals 20 and 21 denote the first and second driven levers, respectively. Both these driven levers 20 and 21 are pivotable around the same axis 19. Also, the levers 20 and 21 are connected to each other by means of first and second torsion coil springs 31 and 32 for use as elastic members.

Specifically, as shown in FIG. 6, a rocking center portion 20*a* of the first driven lever 20 is in the shape of a cup whose base portion is penetrated by a through hole, and is bent inward at about 180° so that a small-diameter portion 20*b* is formed thereon.

A cylindrical connecting ring 34, whose outer and inner diameters are substantially equal to those of the small-diameter portion 20*b*, is inserted in the cup-shaped rocking center portion 20*a* of the first driven lever 20. First and second pins 35*a* and 35*b* protrude from the longitudinal middle portion of the outer surface of the ring 34 in a manner such that they are spaced at a predetermined angle in the circumferential direction.

The first torsion coil spring 31 is fitted on one end side of the connecting ring 34, and one twisted end thereof is hooked to the first pin 35*a*. The second torsion coil spring 32 is fitted on the other end portion of the ring 34, one twisted end thereof is hooked to the second pin 35*b*.

Then, the connecting ring 34, combined with the first and second torsion springs 31 and 32, is inserted into the rocking center portion 20*a* of the first driven lever 20, and the other twisted end of the spring 31 is hooked to the bottom wall of the center portion 20*a*.

Then, the second driven lever 21 is combined. The lever 21 is designed so that a lever portion 21*b* extends from the axial middle portion of the rod-shaped pivot 21*a*. One end side of the pivot 21*a* of the lever 21 is passed through the respective through holes of the rocking center portion 20*a* of the first driven lever 20 and the connecting ring 34, and a stopper 35 is fitted on the projected end of the lever 20.

Thereupon, the first and second driven levers 20 and 21 are elastically connected to each other in the rocking direction. The first and second torsion coil springs 31 and 32 are designed so that they are not twisted by a load which acts thereon as the first and second louvers 11 and 12 are driven, but are twisted against the driving force of the servomotor 17 when the louvers 11 and 12 are restrained from rocking or pivoting.

The first and second driven levers 20 and 21 thus connected are attached to a frame 36, which is fixed in the front case 4. More specifically, the outer peripheral surface of the rocking center portion 20*a* of the first driven lever 20 is rotatably held by means of the frame 36, and the other end portion of the pivot 21*a* of the second driven lever 21 penetrates the frame 36 so as to be rotatably held thereby.

The aforesaid arm 26 for holding the first louver 11 is fixed to the other end portion of the pivot 21*a* of the second driven lever 21 which penetrates the frame 36.

Meanwhile, the third driven lever 24, which is not provided with any mechanism for the aforementioned elastic connection, simply operates in association with the second driven lever 21 through the medium of the second connecting rod 22. Accordingly, the first louver 11 and the second louver 12 which is attached integrally to the third lever 24 through the arm 29, always operate in association with each other.

Referring now to FIG. 1, a suction grill 14 for use as a front panel, arranged on the front of the front case 4, will be described. The suction grill 14, which is formed separately from the front case 4, is provided with a second suction aperture 13 in the middle with respect to the height direction.

A substantially L-shaped arm 14*a* for holding the suction grill 14 is formed integrally with the upper portion of the grill 14. The distal end of the arm 14*a* is pivotally mounted on the upper portion of the front case 4. Thus, the suction grill 14 can be opened and closed. When the grill 14 is opened, the heat exchanger 6 is exposed to the front side of the front case 4.

The respective centers of rocking motion of the first louver 11 and the suction grill 14 are situated on the same axis 19. The distance from the axis 19 to the upper end of the grill 14 is longer than the distance from the axis 19 to the distal end of the first louver 11.

Accordingly, the path (D) of rocking motion of the upper end of the suction grill 14 never intersects that of the distal end portion of the first louver 11. Thus, there is no possibility of the upper end of the grill 14 and the distal end of the louver 11 coming into contact with each other to break the louver 11 when the suction grill 14 is opened.

Figure 7:
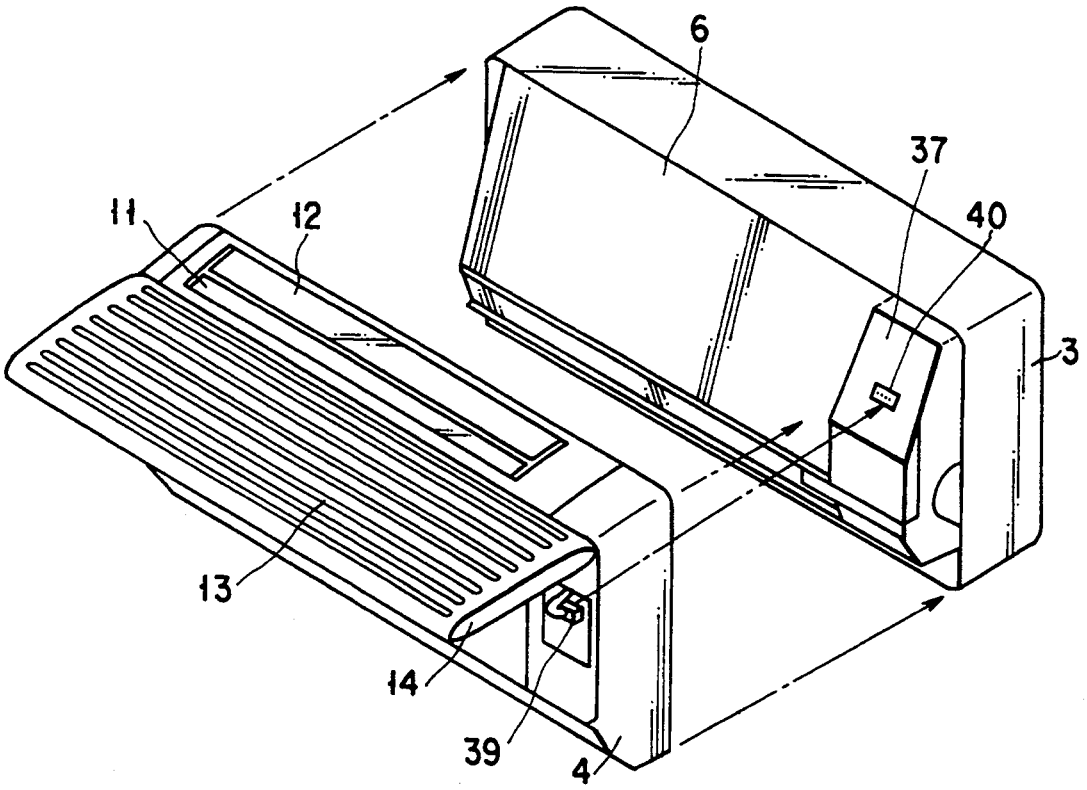
FIG. 7 is a perspective view showing front and rear cases in a separated state.

Referring now to FIG. 7, the connection of the servomotor 17 and an electrical parts box 37 in the rear case 37. As mentioned before, the servomotor 17 is fixed in the front case 4. On the other hand, the parts box 37, which is used to control the indoor unit 2, is contained in the rear case 3. The controller 25 mentioned above is housed in the parts box 37.

A motor-side connector 39, which is attached to the distal end of a lead wire from the servomotor 17, is led out to the front side of the front case 4 with the suction grill 14 open.

A supply-side connector 40 on the electrical parts box 37 is designed so that it is exposed to the front of the front case 4, with the suction grill 14 open, when the case 4 is attached to the rear case 3. Thus, the motor-side connector 39 can be attached to or detached from the supply-side connector 40 with the front case 4 combined with the rear case 3.

The following is a description of the operation of the air conditioner.

When an operating switch of the air conditioner is first turned on, the controller 25 actuates the servomotor 17, to thereby open the first and second louvers 11 and 12.

When the servomotor 17 is operated in the state shown in FIG. 2, the first connecting rod 18 is driven in the direction indicated by the arrow. Following this action of the rod 18, the first driven lever 20 pivots around the axis 19.

When the first and second louvers 11 and 12 are unloaded, the first and second torsion coil springs 31 and 32 cannot be twisted, so that, as shown in FIG. 3, the second and third driven levers 21 and 24 pivot around their respective axes 19 and 23, thereby opening the louvers 11 and 12 through the medium of the arms 26 and 29, respectively.

Thereupon the first suction aperture 10 is opened, so that air in a room is sucked into the front case 4 through the aperture 10. The suction air is rectified downward from the front by the first and second louvers 11 and 12, and is efficiently introduced into the heat exchanger 6, as shown in FIG. 1, to be regenerated thereby. The regenerated air is blown off into the room through a blow-off aperture in the lower portion of the front case 4, by means of the cross-flow fan 7.

When the operating switch is turned off, the controller 25 causes the servomotor 17 to rotate in the reverse direction. Since the drive mechanism 15 operates in the manner opposite to that mentioned above, the first and second louvers 11 and 12 are shut, whereby the first suction aperture 10 is closed.

The indoor unit 2 is maintained in the following manner.

In the first place, the suction grill 14 is opened before starting inspection of a filter attached to the grill 14 or a filter of the dust collector 8.

When inspecting the first and second louvers 11 and 12 or the drive mechanism 15 therefor, in the next place, the motor-side connector 39, which is exposed to the front side of the front case 4, is first removed from the supply-side connector 40 after opening the suction grill 14, and the front case 4 is then removed from the rear case 3, as shown in FIG. 7. By doing this, the first and second louvers 11 and 12 and the louver drive mechanism 15, including the servomotor 17, can be removed in one with the front case 4.

After the maintenance is finished, the front case 4 is attached to the rear case 3, the motor-side connector 39 is connected to the supply-side connector 40, and the suction grill 14 is then closed, reversely following the aforesaid steps of procedure.

This arrangement provides the following effects.

First, when the air conditioner is nonoperating, that is, when the operating switch is off, the first suction aperture 10 is closed by the first and second louvers 11 and 12, there is only a slight possibility of dust collecting at the aperture 10 or entering the heat exchanger 6 through the aperture 10. Thus, the effectiveness of the exchanger 6 is less liable to be lowered when the air conditioner is operating, that is, when the switch is on.

This is a great effect because the filters and the heat exchanger 6 can be protected from dust during the off-season when the air conditioner is not in use, in particular.

Secondly, the first and second louvers 11 and 12 at the first suction aperture 10 are swingable so that their elevation angles are variable, and the elevation angle $\theta_2$ of the second louver 12 is always wider than the elevation angle $\theta_1$ of the first louver 11. As will be mentioned later, therefore, the room air can be sucked in effectively.

Figure 8:
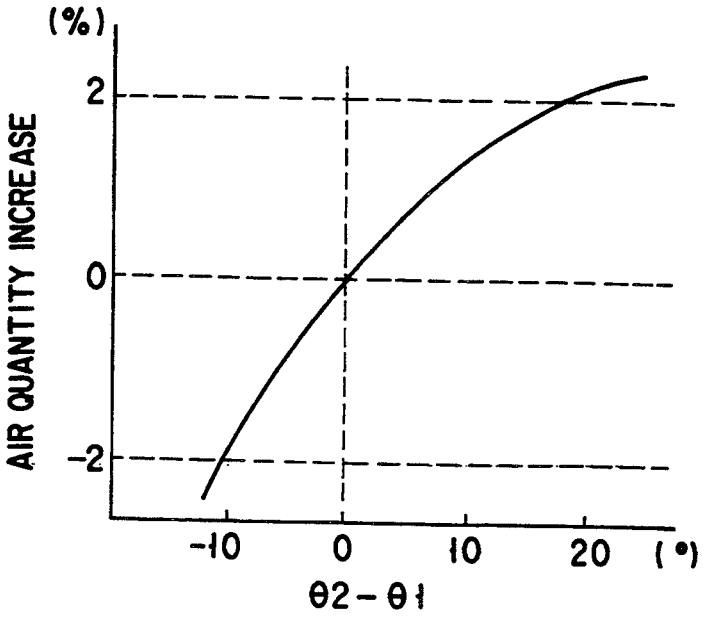
FIG. 8 is a graph showing the relationship between the increase of air quantity and the difference between the elevation angles of the first and second louvers.

FIG. 8 is a graph showing the result of an experiment on the relationship between the increase of air quantity and the difference between the respective elevation angles of the louvers 11 and 12. In FIG. 8, the axes of ordinate and abscissa represent the air quantity increase (%) and the difference $(\theta_2-\theta_1)$ between the elevation angles of the louvers 11 and 12, respectively. Supposing the case where the elevation angles of the louvers 11 and 12 are equal $(\theta_2-\theta_1)$ as a reference (=0%), as shown in FIG. 8, it was confirmed that the air quantity proportionally decreases down to 2% with $\theta_2<\theta_1$ and increases up to about 2% with $\theta_2>\theta_1$.

Since the first and second louvers 11 and 12 have a multi-blade structure, moreover, they can enjoy a high rectifying efficiency, which provides an effect of lowering the level of noises, such as whistling sounds. Since the suction air currents never run against one another in the in the indoor unit 2, as mentioned before, the rectifying capability of the second louver 12 cannot be lowered by the first louver 11.

With this multi-blade structure, furthermore, the rise of the louvers can be lowered despite the use of substantially the same air intake for a single-blade structure, so that restrictions on the level of the location of the indoor unit 2 can be relaxed.

Thirdly, the indoor unit 2 may be installed in a wrong position such that the first or second louver 11 or 12 engages the ceiling as it is opened, and therefore, its opening operation cannot be completed.

In such a case, a force which is greater than the louver driving force acts between the first and second louvers 11 and 12. As a result, the second torsion coil spring 32 is twisted against its restoring force, thereby absorbing the rotation of the servomotor 17. Thus, the servomotor 17 can be protected against an extraordinary load.

During the closing operation of the first and second louvers 11 and 12, moreover, some obstacle may be caught between the louver 11 or 12 and the first suction aperture 10, thereby preventing the closing action of louvers. In this case, a force which is greater than the louver driving force acts between the first and second driven levers 20 and 21. As a result, the first torsion coil spring 31 is twisted against its restoring force this time, thereby absorbing the rotation of the servomotor 17. Thus, the servomotor 17 can be protected against an extraordinary load.

In this manner, the first and second louvers 11 and 12 and the louver drive mechanism 15 can be effectively prevented from being broken.

Fourthly, the first and second louvers 11 and 12 may possibly be open when the suction grill 14 on the front case 4 must be opened to be ready for maintenance.

Since the suction grill 14 never interferes with the distal end portion of the first louver 11, however, these members can be effectively prevented from being damaged.

Fifthly, the servomotor 17 of the louver drive mechanism 15 according to the present invention is fixed to the front case 4, although the operation units, including the cross-flow fan 7, heat exchanger 6, etc., are conventionally mounted on the rear case side.

Further, the motor-side connector 39 associated with the servomotor 17 and the supply-side connector 40 on the rear case 3 can be easily attached to or detached from each other by opening the suction grill 14 of the front case 4.

In this arrangement, the first and second louvers 11 and 12 and the louver drive mechanism 15 can be prearranged for maintenance by only removing the front case 4. In removing the front case 4, moreover, there is no need of the troublesome operation for attaching or detaching the connectors 39 and 40 while holding the case 4. Thus, the efficiency of operations for maintenance, disassembly, and assembly is improved.

It is to be understood that the present invention is not limited to the embodiment described above, and that various changes and modifications may be effected therein by one skilled in the art without departing from the scope or spirit of the invention.

In the above-described embodiment, the first and second louvers 11 and 12 are used as the open-close means for opening and closing the first suction aperture 10. Alternatively, however, a shutter may be used to prevent dust or the like from entering the indoor unit 2, for example.

Although the servomotor 17 is used as the drive mechanism for the first and second louvers 11 and 12 according to the foregoing embodiment, moreover, it may be replaced with, for example, a linear motor.

According to the embodiment described above, furthermore, the first and second torsion coil springs 31 and 32 are used as the elastic members for connecting the first and second driven levers 20 and 21. Alternatively, however, rubber or the like may be used for this purpose, for example.

Further, the first and second driven levers 20 and 21 may be connected with the same result by using elastically twistable shaft members.

What is claimed is:

1. An air conditioner comprising:

a case assembly having a front portion, a rear portion, and a top portion in which a suction aperture is formed;

a heat exchanger, located in the case assembly, for exchanging heat with indoor air introduced through the suction aperture;

a blower, located in the case assembly, for supplying the indoor air introduced through the suction aperture into the heat exchanger and for expelling the indoor air from the case assembly after the heat exchange by the heat exchanger; and open-close means, provided in the top portion of the case assembly, for selectively opening or closing the suction aperture, said open-close means including:

an open-close plate for selectively opening or closing the suction aperture, said open-close plate having a first end pivotally mounted on the case assembly, and a second end;

a drive mechanism, provided for the case assembly, for pivoting the open-close plate;

connecting means, located between the open-close plate and the drive mechanism, for elastically connecting the open-close plate to the drive mechanism; and control means for controlling the drive mechanism, said control means pivoting the open-close plate outwardly in an opening direction to open the suction aperture when the air conditioner starts operating, and pivoting the open-close plate in an closing direction opposite said opening direction to close the suction aperture when the air conditioner stops operating so that dust will not enter the suction aperture and collect on the heat exchanger.

2. An air conditioner according to claim 1, wherein said open-close means includes:

open-close plates for selectively opening or closing the suction aperture, each of said open-close plates having a first end pivotally mounted on the case assembly, and a second end;

said open-close plates having pivoting axes, respectively, parallel to, and spaced from the front portion of the case assembly.

3. An air conditioner according to claim 2, wherein said open-close means further includes a drive mechanism, provided in the case assembly, for pivoting the open-close plates at different angles.

4. An air conditioner according to claim 3, wherein said drive mechanism pivots the open-close plates such that a pivot angle increases from an open-close plate closest to the front portion of the case assembly toward an open-close plate closest to the rear portion of the case assembly.

5. An air conditioner according to claim 1, wherein said case assembly includes:

a main body having a front section and a rear section;

a front panel attached to the front section of the main body; and a holding means for holding the front panel in an open state or a closed state with reference to the main body, wherein said holding means includes an arm mechanism having a first end and a second end, and a distance between the first and second ends of the arm means is longer than a distance between the first and second ends of the open-close plate located closest to the front portion of the case assembly, said first end of the holding mechanism being supported by the case assembly and pivotable around a pivoting axis of the open-close plate, and said second end of the holding mechanism being fixed to the front panel.

6. An air conditioner according to claim 1, wherein said connecting means includes a coil spring having a first end connected to the open-close plate and a second end connected to the drive mechanism, and said coil spring is elastically twisted in a pivoting direction of the open-close plate when the open-close plate is prevented from pivoting during actuation of the drive mechanism.

7. An air conditioner according to claim 1, wherein said case assembly includes:

a rear unit constructed and arranged to be mounted on a planar surface, which includes the rear portion; and a front unit which is detachably fixed to the rear unit, the front unit includes the front and top portions wherein said open-close means includes a plurality of open-close plates for selectively opening or closing the suction aperture, each of said open-close plates having a first end pivotally mounted on the front case, and a second end, said drive mechanism being located in the front unit, for pivoting the open-close plates, wherein said drive mechanism includes:

a motor for pivoting the open-close plates; and a motor-side connector leading from the motor to the front portion of the front unit.

8. An air conditioner according to claim 7 wherein said rear unit is provided with a supply-side connector to which the motor-side connector is detachably connected, and the supply-side connector can be led to the front portion of the front unit when the rear unit is fitted with the front unit.

9. An air conditioner comprising:

a case assembly having a front portion, a rear portion, and a top portion in which a suction aperture is formed;

a heat exchanger, located in the case assembly, for exchanging heat with indoor air introduced through the suction aperture;

a blower, located in the case assembly, for supplying the indoor air introduced through the suction aperture into the heat exchanger and for expelling the indoor air from the case assembly after the heat exchange by the heat exchanger; and open-close means, provided in the top portion of the case assembly, for selectively opening or closing the suction aperture, said open-close means including:

open-close plates for selectively opening or closing the suction aperture, each of said open-close plates having a first end pivotally mounted on the case assembly, and a second end, said open-close plates having pivoting axes, respectively, parallel to and spaced from the front portion of the case assembly;

a drive mechanism, provided in the case assembly, for pivoting the open-close plates at different angles, said drive mechanism pivots the open-close plates such that a pivot angle increases from an open-close plate closest to the front portion of the case assembly towards an open-close plate closest to the rear portion of the case assembly; and control means for controlling the drive mechanism, said control means pivoting the open-close plates outwardly in an opening direction to open the suction aperture when the air conditioner starts operating, and pivoting the open-close plates in an closing direction opposite said opening direction to close the suction aperture when the air conditioner stops operating so that dust will not enter the suction aperture and collect on the heat exchanger.

10. An air conditioner according to claim 9, wherein said case assembly includes:

a main body having a front section and a rear section;

a front panel attached to the front section of the main body; and a holding means for holding the front panel in an open state or a closed state with reference to the main body, wherein said holding means includes an arm mechanism having a first end and a second end, and a distance between the first and second ends of the arm means is longer than a distance between the first and second ends of the open-close plate located closest to the front portion of the case assembly, said first end of the holding mechanism being supported by the case assembly and pivotable around a pivoting axis of the open-close plate, and said second end of the holding mechanism being fixed to the front panel.

11. An air conditioner according to claim 9, wherein said case assembly includes:

a rear unit constructed and arranged to be mounted on a planar surface, which includes the rear portion; and a front unit which is detachably fixed to the rear unit, the front unit includes the front and top portions, wherein said open-close means includes a plurality of open-close plates for selectively opening or closing the suction aperture, each of said open-close plates having a first end pivotally mounted on the front case, and a second end, said drive mechanism being located in the front unit, for pivoting the open-close plates, said drive mechanism including:

a motor for pivoting the open-close plates; and a motor-side connector leading from the motor to the front portion of the front unit.

12. An air conditioner according to claim 11, wherein said rear unit is provided with a supply-side connector to which the motor-side connector is detachably connected, and the supple-side connector can be led to the front portion of the front unit when the rear unit is fitted with the front unit.

* * * * *